US011596280B2

(12) United States Patent
Kramer

(10) Patent No.: US 11,596,280 B2
(45) Date of Patent: Mar. 7, 2023

(54) TOILET SHIELD

(71) Applicant: BETTER TRICK, INC., Columbus, NE (US)

(72) Inventor: James William Kramer, Columbus, NE (US)

(73) Assignee: BETTER TRICK, INC., Columbus, NE (US)

( * ) Notice: Subject to any disclaimer, the term of this patent is extended or adjusted under 35 U.S.C. 154(b) by 0 days.

(21) Appl. No.: 17/335,190

(22) Filed: Jun. 1, 2021

(65) Prior Publication Data

US 2021/0369062 A1 Dec. 2, 2021

Related U.S. Application Data

(60) Provisional application No. 63/033,326, filed on Jun. 2, 2020.

(51) Int. Cl.
*A47K 13/26* (2006.01)
*A47K 13/16* (2006.01)

(52) U.S. Cl.
CPC ..... *A47K 13/26* (2013.01); *A47K 13/16* (2013.01)

(58) Field of Classification Search
CPC ..... A47K 13/14; A47K 11/04; A47K 13/24; E03D 9/00; A61F 5/4556
USPC ..... 4/144.1–144.4, 300.3
See application file for complete search history.

(56) References Cited

U.S. PATENT DOCUMENTS 5,146,637 A * 9/1992 Bressler ..... A61B 10/007 4/144.1
6,460,200 B1 * 10/2002 Mottale ..... A61F 5/4556 4/144.1
2005/0066431 A1 * 3/2005 Liggieri ..... A47K 13/24 4/300.3
2015/0238058 A1 * 8/2015 Couch ..... E03D 9/00 4/300.3
2017/0035600 A1 * 2/2017 Preciado ..... A61F 5/4556
2019/0093331 A1 * 3/2019 Takahashi ..... A47K 13/24

* cited by examiner

*Primary Examiner* — Christine J Skubinna
(74) *Attorney, Agent, or Firm* — Morris Patent Law, P.C., L.L.O.

(57) ABSTRACT

A toilet shield comprises a tube, a first arm, and a second arm. The first arm is coupled with a first side of an opening of the tube and comprises a first plurality of adjustment holes configured into the first arm. The second arm is coupled to a second side of the opening of the tube and comprises a second plurality of adjustment holes configured into the second arm. The tube is configured such that a lumen of the tube opens in response to the arms being extended in generally opposite in directions.

18 Claims, 15 Drawing Sheets

TOILET SHIELD

CROSS-REFERENCE TO RELATED U.S. APPLICATIONS—PROVISIONAL

This application claims priority to and benefit of the provisional patent application, Ser. No. 63/033,326, entitled "Toilet Shield," by James Kramer, with filing date Jun. 2, 2020, which is herein incorporated by reference in its entirety.

BACKGROUND

Hundreds of thousands of people experience diarrhea/loose stools every day in the United States alone. Some have a temporary problem that only happens occasionally. Some have life-long, continual, daily afflictions which may be caused by a condition or disease such as irritable bowel syndrome, Crohn's disease, or malabsorption, to name but a few.

One of the negative consequences associated with this is that it creates an undesirable toilet cleaning problem due to splatter of the loose stool in regions of a toilet that are not easily washed away when the toilet is flushed. For example, liquified feces of the loose stool may spray with force in multiple directions and may also splash/rebound upward from the water in the bowl or from the bowl itself to foul the undersurface of the porcelain toilet rim, the underside of the toilet seat, and can end up traveling even higher on the toilet and in hard-to-reach places. In such instances, much of the sprayed and splattered feces remains in these locations after flushing the toilet.

People thusly afflicted can be embarrassed while at work or in another person's home by having to clean up after themselves which takes time and may be hard to accomplish. Moreover, much of this spraying/splattering of feces occurs in care situations where the person causing it is not the person who is involved with the cleaning of it afterward.

People who have diarrhea/loose stool issues often use a toilet more than once a day. This means that these disgusting cleaning burdens may occur many hundreds of thousands or millions of times a day in the United States alone.

BRIEF DESCRIPTION OF DRAWINGS

The accompanying drawings, which are incorporated in and form a part of the Description of Embodiments, illustrate various embodiments of the subject matter and, together with the Description of Embodiments, serve to explain principles of the subject matter discussed below.

FIG. 3C top view of a bracket and hook, in accordance with various embodiments.

Figure 1A:
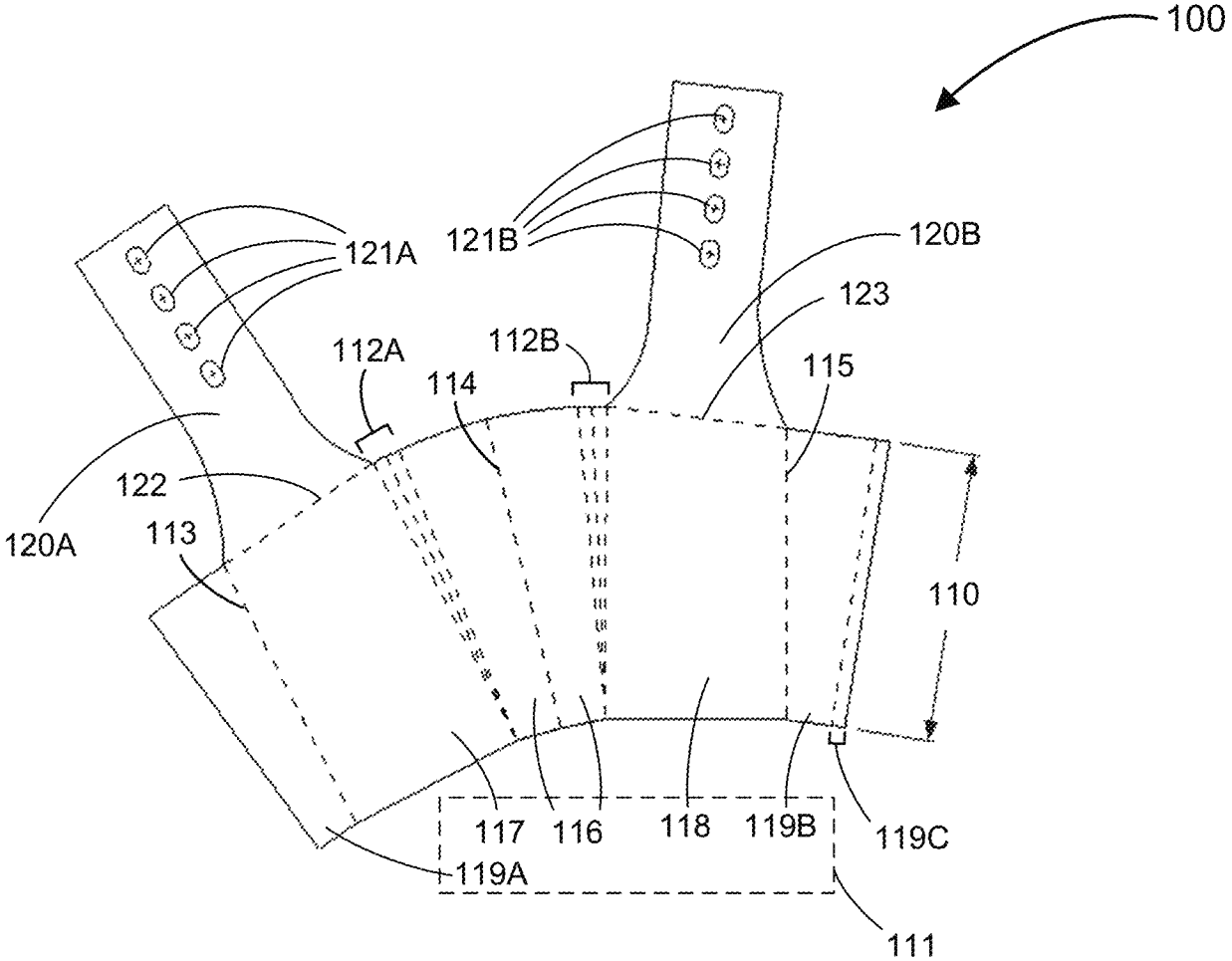
FIG. 1A illustrates an example pattern for folding a toilet shield cut from a sheet of flushable paper or other water soluble/dissolvable and flushable material, in accordance with various embodiments.

Unless specifically noted, the drawings referred to in this Brief Description of Drawings should be understood as not being drawn to scale. Herein, like items are labeled with like item numbers.

DESCRIPTION OF EMBODIMENTS

Reference will now be made in detail to various embodiments of the subject matter, examples of which are illustrated in the accompanying drawings. While various embodiments are discussed herein, it will be understood that they are not intended to limit to these embodiments. On the contrary, the presented embodiments are intended to cover alternatives, modifications and equivalents, which may be included within the spirit and scope the various embodiments as defined by the appended claims. Furthermore, in this Description of Embodiments, numerous specific details are set forth in order to provide a thorough understanding of embodiments of the present subject matter. However, embodiments may be practiced without these specific details. In other instances, well known methods, procedures, components, and circuits have not been described in detail as not to unnecessarily obscure aspects of the described embodiments.

Overview of Discussion

As previously described, people who have chronic diarrhea/loose stools use a toilet more than once a day and create a cleaning problem due to un-flushable fecal splatter in the toilet bowl and other regions of the toilet.

Toilet Shields are not designed to eliminate all immediate cleaning but rather to decrease it substantially and to limit cleaning to areas that are easily reached with a toilet brush requiring little effort. The toilet shield described herein serves to solve or minimize this cleaning problem by reducing and/or preventing splatter of feces. Toilet shields described herein are designed to accomplish protection of a toilet from becoming fouled by liquid and/or splattering feces while using an economy of flushable paper or other flushable material to avoid becoming a burden on septic systems and waste treatment plants. For example, in a flushable paper embodiment, each single use toilet shield is made of an amount of flushable paper which may be equal to as little as several sheets of toilet paper.

The extensive amount of cleaning required in these situations where a toilet is fouled with fecal splatter when there is no toilet shield requires much more paper to be used (than would be contained in a toilet shield made of flushable paper). Additionally, the cleaning of a toilet fouled in the absence of a toilet shield may also result in the use of paper (e.g., paper towels) that is not designed to be flushable, thus creating a burden on septic systems and waste treatment plants if it is flushed.

Herein some example toilet shields, example toilet shielding systems, and example methods of use are described. Generally, the toilet shields supply one or more substantially vertical surfaces suspended within the bowl of a toilet such that the substantially vertical surfaces intercept the stream/splatter of diarrheal feces before they impact with the hard surface of the toilet bowl or the hard surface of the water in the bowl. This interception prevents or reduces the amount of splatter off of the bowl or the water. In situations where a stream of diarrheal feces is predominately directed downward and/or downward/reward toward the rear of a toilet bowl, the substantially vertical surfaces of the toilet shield intercept the stream and reduce/eliminate splatter. This reduces splatter near the rear of the toilet bowl, under the rim of the toilet bowl, and splatter that lands above where the flushing water can reach it such as on the inside rim and seat of the toilet bowl.

Example Toilet Shields

FIG. 1A illustrates an example pattern for folding a toilet shield 100 which has been cut from a sheet a sheet of flushable paper or other water soluble/dissolvable and flushable material, in accordance with various embodiments. By "flushable" what is meant is that the material will either dissolve, degrade in water, or else not clog or disrupt toilet lines, sewer lines, a sewer system, or a septic system when flushed. Dashed lines 113, 114, and 115 in FIG. 1A illustrate regions where folding occurs to join portion 119A and 119C together such that portions 119A and 119B form a front interior wall 119 of a tube 110. For example, portion 119C may be affixed to portion 119A by any suitable means to include, but not limited to: gluing, knurling, crimping, and folding. The tube 110 may be expanded to open an interior lumen 111 of the tube 110. The lumen 111 has a rear interior wall 116, a left side interior wall 117, a right side interior wall 118, and a front interior wall 119 (formed by portions 119A and 119B when joined). In some embodiments, the tube 110 may include one or more pleats 112. Dashed lines in regions 112A and 112B in FIG. 1A illustrate regions where folding may occurs to create expandable pleats 112A and 112B in tube 110. The tube 110 includes at least two arms 120 (120A and 120B) disposed on edges of a top opening of the tube 110. By folding on dashed fold lines 122 and 123, arms 120A and 120B respectively are caused to extend from the tube 110 at substantially right angles to the vertical length of the tube 110. In some embodiments, an arm 120 may include one or more adjustment holes 121 (e.g., adjustment holes 121A & 121B) for interfacing with a hook of a bracket disposed on the rim of a toilet bowl. In some embodiments, the arms 120 may include an adhesive on a side that is intended to couple with the rim of a toilet bowl. The tube 110 of toilet shield 100 is open on at least one end (e.g., the top, near the arms 120) for receiving human feces from defecation; and may be open on both ends. Although a cutting/folding pattern is illustrated in FIG. 1, other mechanisms for manufacturing and/or assembly of the toilet shield 100, may be employed.

Figure 1B:
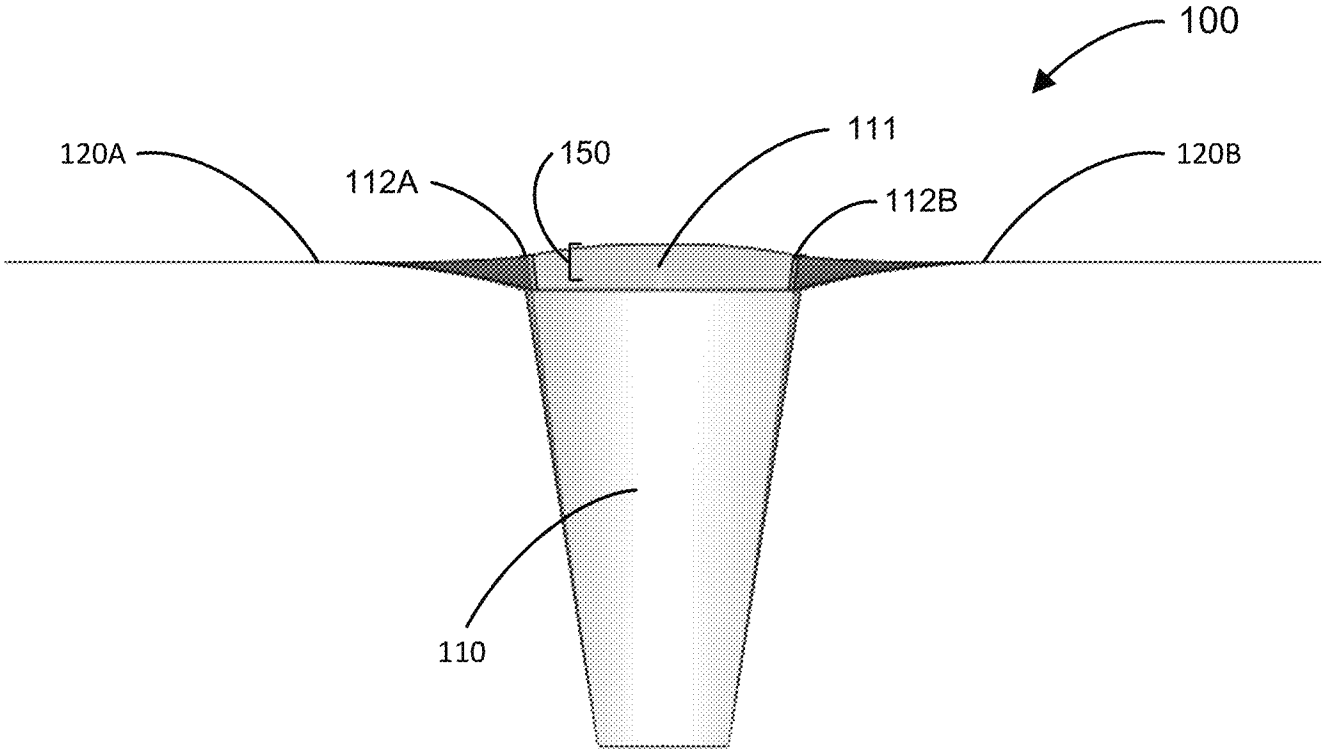
FIG. 1B is a front side view of the toilet shield with the arms extended from opposite sides of the top opening of the tube, in accordance with various embodiments.

FIG. 1B is a front side view of the toilet shield 100 with the arms 120 (120A and 120B) extended from opposite sides of the top opening of the tube 110, in accordance with various embodiments. Extending the arms 120 in generally opposite directions causes the lumen 111 of tube 110 to open. In FIG. 1B, the interior lumen 111 is visible towards the rear due to this embodiment exhibiting a raised collar on the rear side of the tube 110.

Further, in some embodiments, the design of the toilet shield 100 allows for a raised collar 150 to rise above the horizontal arms 120 in the rear of the toilet shield only. In some instances, liquid feces under pressure of expulsion from the human body tends to spray toward the rear of the toilet more than toward the front. The raised collar 150 improves the interface between the defecating person and the shield 100 in order to catch/deflect more liquid feces in such situations.

In some embodiments, on either side of the raised rear collar 150 there is a vertical pleat 112 (112A, 112B). The purpose of this pleat 112 is to discourage tearing of the arm 120 at these attachment sites, to allow for better raising of the collar 150, to increase the extension of the substantially vertical portion of the toilet shield 100 without adding much more paper/flushable material, and to improve the interface between the defecating person and the toilet shield 100 by decreasing the distance between the two.

Figure 1C:
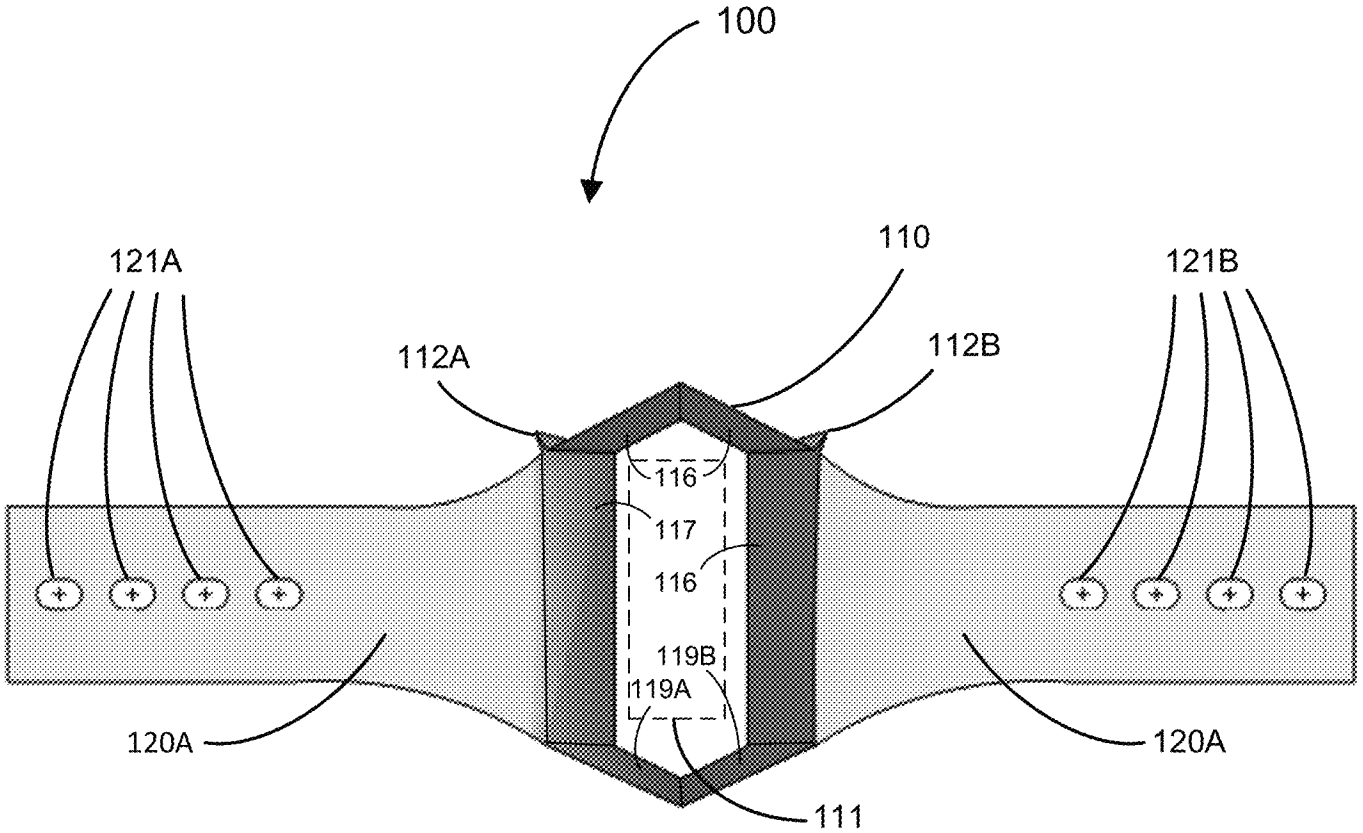
FIG. 1C is a top view which illustrates the open lumen (interior) of the tube which occurs in response to extension of the arms in opposite directions from one another, in accordance with various embodiments.

FIG. 1C is a top view which illustrates the open lumen 111 of the tube 110 which occurs in response to extension of the arms 120 (120A & 120B) in generally opposite directions from one another, in accordance with various embodiments. In various tubular embodiments, the tube 110 of a toilet shield 100 (and its interior lumen 111, when open) may have a generally cylindrical, hexagonal, rectangular, conical, bell, or other tubular shape. The adjustment holes 121 are depicted as circular, but may be formed in other shapes such as oval or rectangular.

Figure 1D:
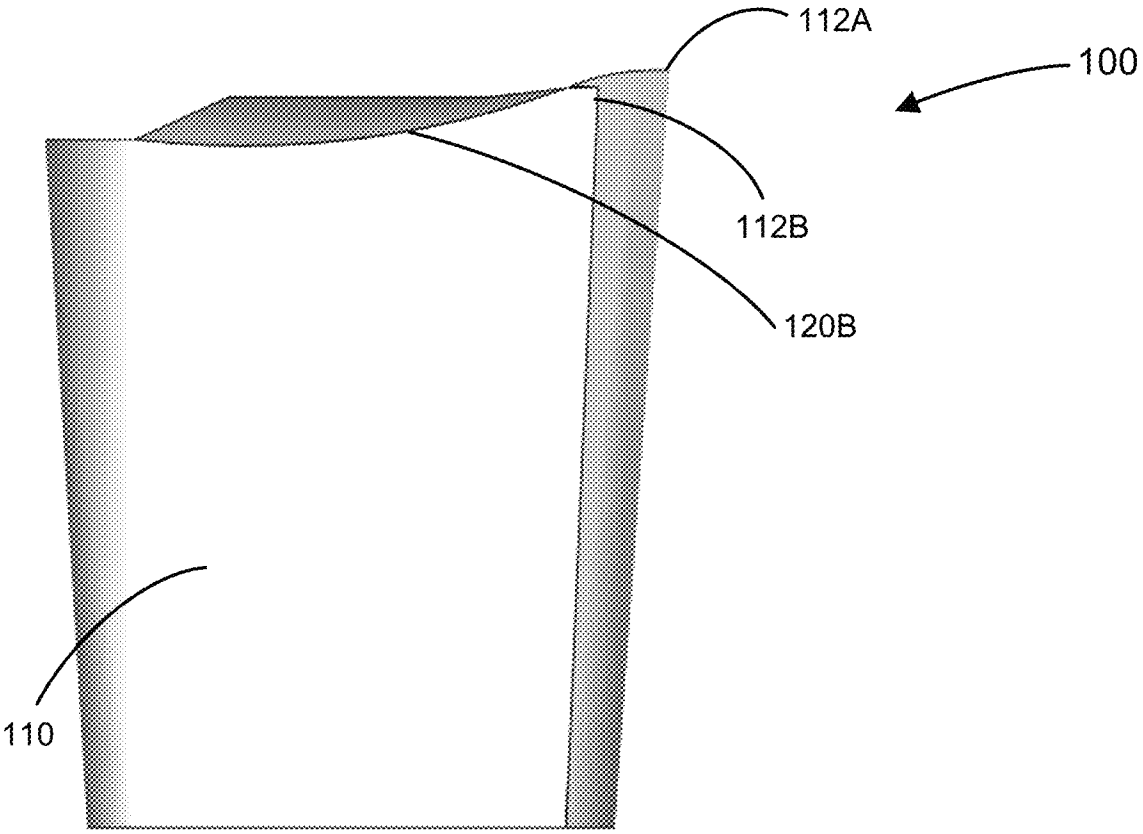
FIG. 1D is a right side view of the toilet shield with the right side arm extended, in accordance with various embodiments.

FIG. 1D is a right side view of the toilet shield 100 with the right side arm 120B extended, in accordance with various embodiments.

Figure 1E:
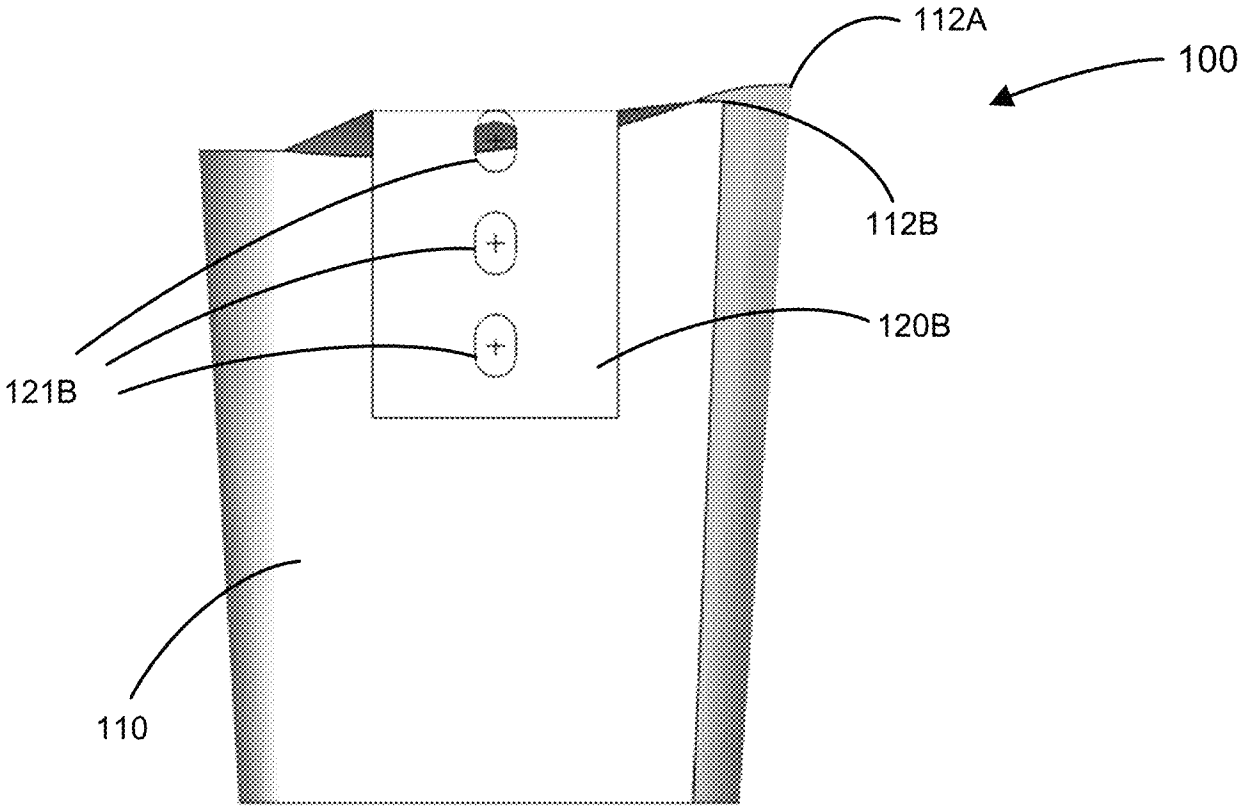
FIG. 1E is a right side view of the toilet shield with the right side arm extended and also bent at an angle, in accordance with various embodiments.

FIG. 1E is a right side view of the toilet shield 100 with the right side arm 120B extended and also bent at an angle (e.g., approximately a right angle) as it would be when coupled with a hook or other fastening means on the rim of a toilet bowl, in accordance with various embodiments.

Figure 1F:
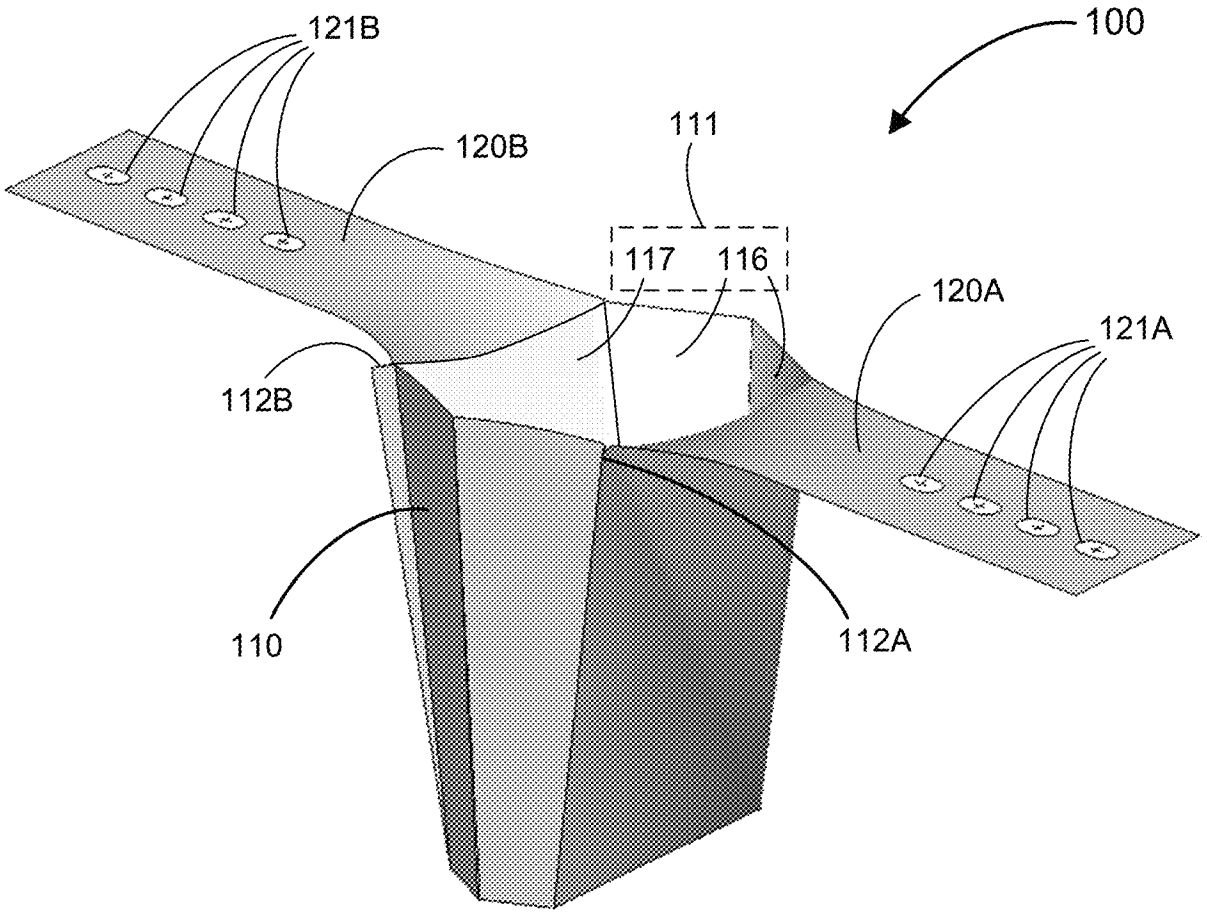
FIG. 1F is an upper rear perspective view of the toilet shield with the arms extended to open the lumen of the tube, in accordance with various embodiments.

FIG. 1F is an upper rear perspective view of the toilet shield 100 with the arms 120 (120A & 120B) extended to open the lumen 111 of the tube 110, in accordance with various embodiments.

Toilet shields 100 may be provided in a dispenser which holds multiple toilet shields 100, may be provided in packages with several toilet shields 100, or may be provided in packages with a single toilet shield 100.

Figure 2A:
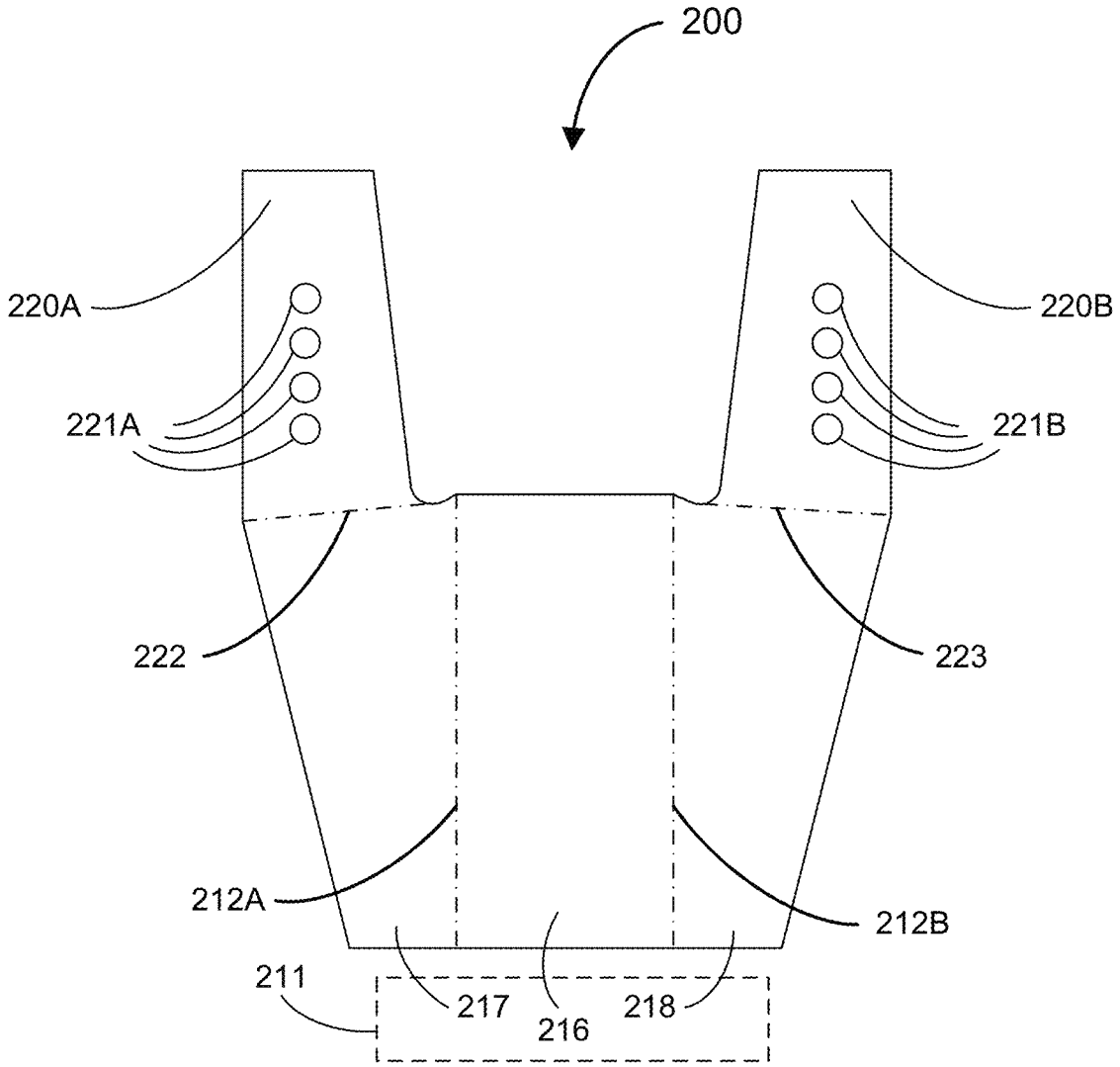
FIG. 2A illustrates a second example pattern for folding a toilet shield cut from a sheet of flushable paper or other water soluble/dissolvable and flushable material, in accordance with various embodiments.

FIG. 2A illustrates a second example pattern for folding a toilet shield 200 which has been cut from a sheet a sheet of flushable paper or other water soluble/dissolvable and flushable material, in accordance with various embodiments. By "flushable" what is meant is that the material will either dissolve, degrade in water, or else not clog or disrupt toilet lines, sewer lines, a sewer system, or a septic system when flushed. By folding down and outward on first arm fold line 222 and second arm fold line 223, arms 220A and 220B are formed. Dashed lines 212A and 212B in FIG. 2A illustrate regions where the pattern may be folded. By folding inward on first vertical fold line 212A and second vertical fold line 212B a vertical gutter shape is formed which comprises an interior channel 211. Absent folding on first vertical fold line 212A and the second vertical fold line 212B, the vertical shape is more like a curtain (which may have some curvature or appear to have three sides, depending on the positioning of arms 220A and 220B when in use), rather than like a gutter with an internal channel. Channel 211 may be expanded to open when the arms 220A and 22B are spread in generally opposing directions. The channel 211 has a rear vertical wall 216, a left side vertical wall 217, and a right side vertical wall 218. It is open on a fourth vertical side and does not create a fully enclosed lumen 111 like toilet shield 100 of FIG. 1B. The toilet shield 200 of FIG. 2A includes at least two arms 220 (220A & 220B) disposed on edges of an upper opening of the channel 211. In some embodiments, an arm 220 (220 and/or 220B) may include one or more adjustment holes 221 (e.g., holes 221A in arm 220A and/or holes 221B in arm 220B) for interfacing with a hook of a bracket disposed on the rim of a toilet bowl. The adjustment holes 221 are depicted as circular, but may be formed in other shapes such as oval or rectangular. In some embodiments, adhesive or other fastening means may be utilized to couple the arms 220 to the toilet. For example an adhesive with a peel off covering may be disposed on one or more surfaces of arms 220. The channel 211 is open on at least one end (the upper portion near the arms) for receiving human feces from defecation; and may be open on both ends. Although a cutting/folding pattern is illustrated in FIG. 2A, other mechanisms for manufacturing and/or assembly of the toilet shield 200, may be employed.

Figure 2B:
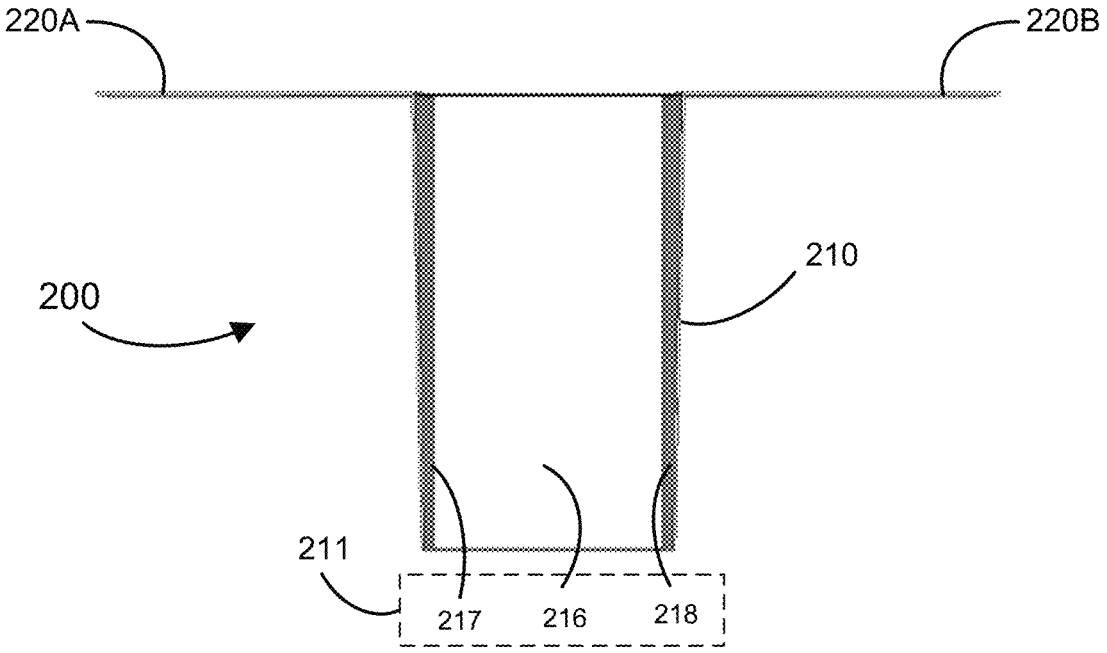
FIG. 2B illustrates a front view of the gutter shaped toilet shield of FIG. 2A after folding on the fold lines, in accordance with various embodiments.

FIG. 2B illustrates a front view of the gutter 210 shaped toilet shield 200 of FIG. 2A after folding on the fold lines 212A, 212B, 222, and 223, in accordance with various embodiments. Both the exterior gutter 210 shape and its interior channel 211 are visible. The arms 220 (220A & 220B) may be fastened to brackets or otherwise secured/coupled to a toilet seat or rim of a toilet bowl in order to suspend the toilet shield 200 in place within the bowl of a toilet in a similar manner to that which has been previously described and which is depicted in FIGS. 3-6B. In some embodiments, the bottom edges of the rear vertical wall 216, the left side vertical wall 217, and the right side vertical wall 218 trail into the water in the toilet bowl. Lower portions of the substantially vertical walls (216, 217, and 218) which trail into the water of the toilet bowl pull downward on the toilet shield 200 help to hold the toilet shield 200 in place and give the toilet shield 200 some additional structural integrity. The rear wall 216, side walls 217 and 218, and any lower portions of the toilet shield 200 floating or suspended in the water of the toilet bowl serve to decelerate falling/streaming fecal material from a bowel movement, which results in in less upward splashing and splattering of fecal material. This greatly reduces fecal splatter and thus the reduces embarrassment and/or reduces the cleaning burden associated with excessive fecal splatter in a toilet bowl.

Further, in some embodiments, the design of the toilet shield 200 allows for a raised collar (not depicted, but similar to raised collar 150 of FIG. 1B) to rise above the horizontal arms 220 in the rear of the toilet shield only. In some instances, liquid feces under pressure of expulsion from the human body tends to spray toward the rear of the toilet more than toward the front. The inclusion of a raised collar may improve the interface between the defecating person and the shield 200 in order to catch/deflect more liquid feces in such situations.

Figure 2C:
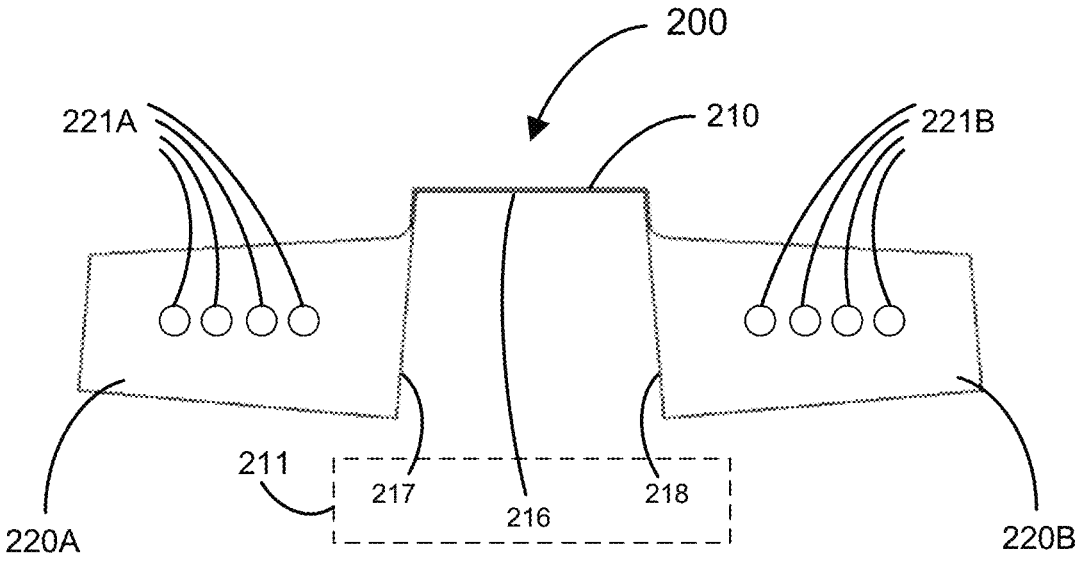
FIG. 2C is a top view of the gutter shaped toilet shield of FIG. 2B, in accordance with various embodiments.

FIG. 2C is a top view of the gutter shaped toilet shield 200 of FIG. 2B, in accordance with various embodiments.

Figure 2D:
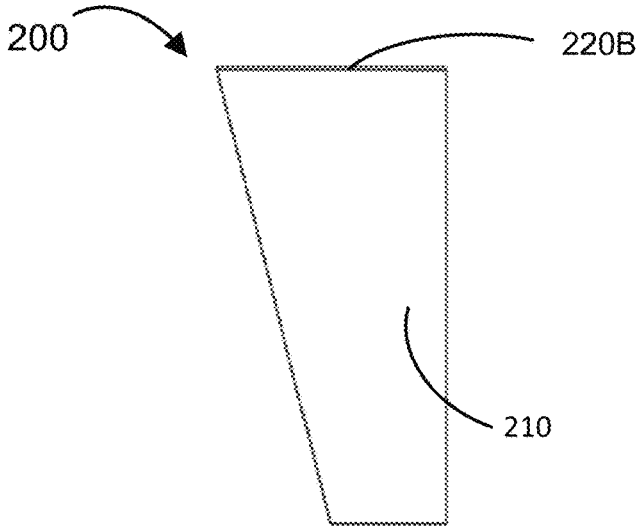
FIG. 2D is a right side view of the gutter shaped toilet shield of FIG. 2B, in accordance with various embodiments.

FIG. 2D is a right side view of the gutter shaped toilet shield 200 of FIG. 2B, in accordance with various embodiments.

Figure 2E:
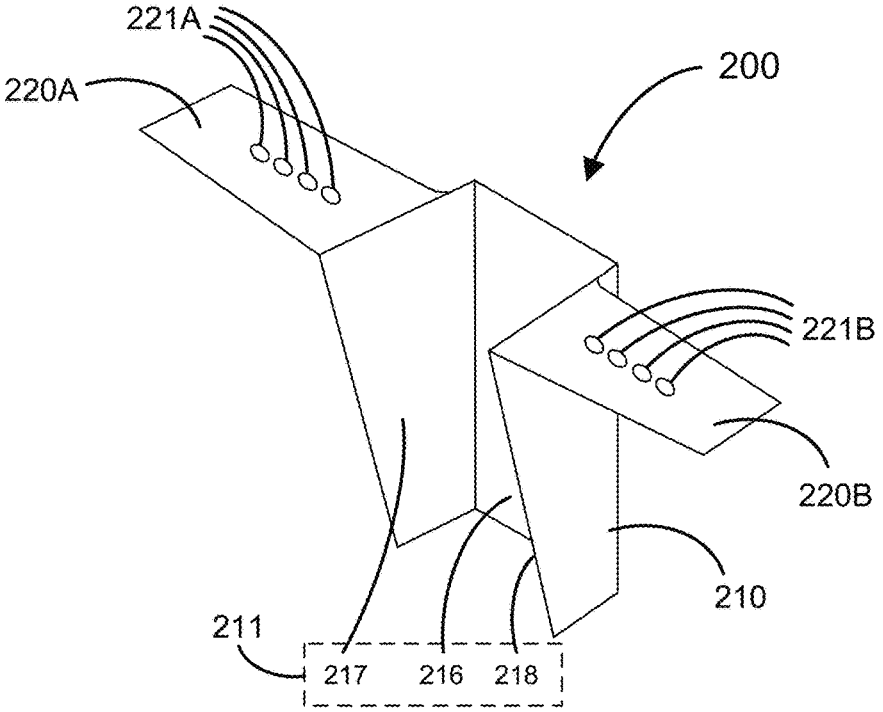
FIG. 2E is an upper right perspective view of the gutter shaped toilet shield of FIG. 2B, in accordance with various embodiments.

FIG. 2E is an upper right perspective view of the gutter shaped toilet shield 200 of FIG. 2B, in accordance with various embodiments.

Toilet shields 200 may be provided in a dispenser which holds multiple toilet shields 100, may be provided in packages with several toilet shields 200, or may be provided in packages with a single toilet shield 200.

As previously discussed, toilet shields 100 and 200 are made of flushable paper or other water soluble/dissolvable and flushable material such as PVA (polyvinyl alcohol) film. By "flushable" what is meant is that material from which the toilet shield 100/200 is formed is safe to flush down a toilet in a similar fashion to toilet paper, without risk of clogging plumbing or causing harm to a wastewater treatment plant. Such material which is safe to flush in this manner is referred to as "flushable material." The toilet shield 100/200 comprises a vertical tube 110, gutter 210, or curtain, which is open on one or both ends, and arms 120/220 on disposed on the edges of an open end. One or more of tube 110, gutter 210, or curtain and the arms 120/220 may be composed of flushable material, in some embodiments. The tube 110, gutter 210, or curtain may be composed of a different flushable material than the arms 120/220, in some embodiments. In some embodiments, certain portions such as seams, pleats 112, fold lines, adjustment holes 121/221 or potential weak spots may be coated with a biodegradable and/or flushable overspray. The overspray may add structural integrity to fail points. The overspray may provide other advantages such providing a pleasant scent and/or adding a measured amount of water resistance (i.e., slowing the dissolvability) of a portion of the toilet shield 100/200.

In various embodiments, the substantially vertical sides of the toilet shield 100/200 may be smooth or faceted. The end of the toilet shield which is configured with arms 120/220 is the top end of the toilet shield 100/200 when in use. The toilet shield 100/200 may be stored in a flattened state prior to use, and the lumen 111, channel 211, or curtain opened/deployed for use by extending the arms 120/220 away from each other in directions which are generally orthogonal to the direction in which the toilet shield 100/200 extends into the bowl of the toilet. In some embodiments the toilet shield 100/200 may be folded and packaged so that it may be easily transported by a person, such as in a purse, wallet, or pocket. In other embodiments, a plurality of toilet shields 100/200 may be packaged together.

In some embodiments, the design of the toilet shield 100/200 with regard to the attachment of the horizontal arms 120/220 to the substantially vertical portion (e.g., the tube 110 or gutter 210) allows for the lumen 111, channel 211, or curtain of the toilet shield 100/200 to open/deploy when the arms 120/220 are pulled away from each other in generally opposite directions.

Example Bracket and Hook for Securing Arms of a Toilet Shield

Figure 3D:
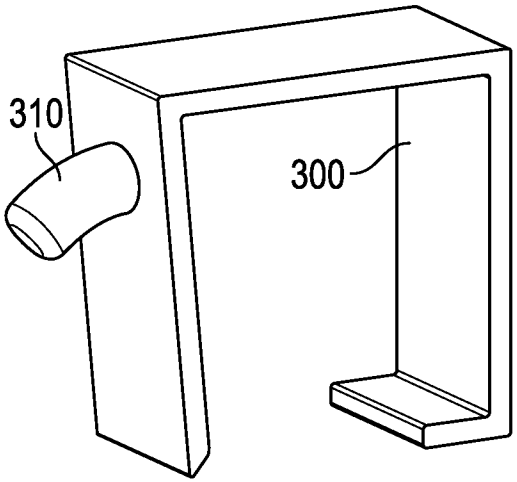
FIG. 3D shows a right side perspective view of a bracket and hook, in accordance with various embodiments.
Figure 3A:
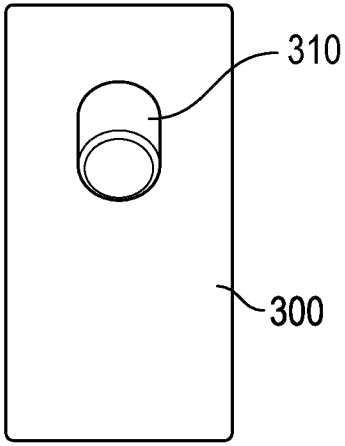
FIG. 3A shows a front view of a bracket and hook, in accordance with various embodiments.

FIG. 3A shows a front view of a bracket 300 and hook 310, in accordance with various embodiments. The bracket 300 may be installed on the rim of a toilet bowl. The hook 310, which is coupled with the bracket 300 is configured to engage with an arm 120/220 of a toilet shield, either by piercing the material of the arm or by being inserted in a preconfigured adjustment hole 121/221 of the arm 120/220. Although hooks 310 are depicted as being bent, thy may be straight in some embodiments. Although hooks 310 are depicted as circular in shape they may be formed in other suitable shapes, such as rectangular, square, oval, etc. One or more ridges or standoffs may be configured onto a surface of the bracket 300 in order to provide an interface between a bracket 300 and a toilet shield lowered on top of a bracket 300.

These brackets 300 snap into place by virtue of their elastomeric quality. In some embodiments, the brackets include a lip which secures to the underside of the rim of the toilet. On the outward side of the toilet, on the outward facing lateral sides, each bracket 300 has a hook 310 extending outward, away from the toilet with the end of the hook 310 pointing downward so that the hook 310 is open on the bottom. These brackets 300 can be left in place for months or can be placed for one time use and then removed.

Figure 3C:
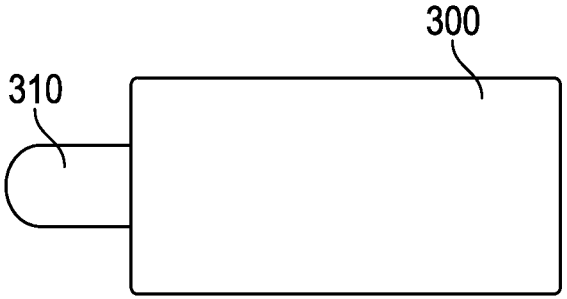
Figure 3B:
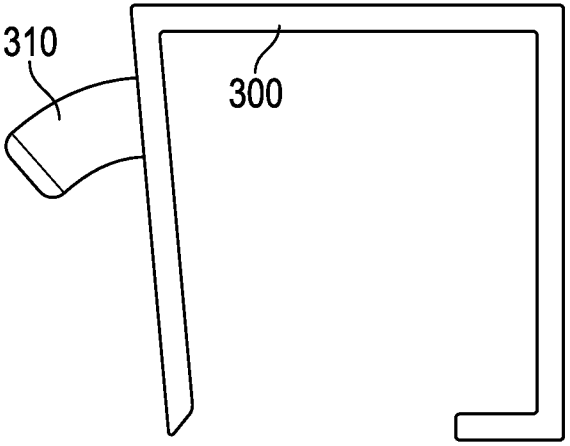
FIG. 3B shows a right side view of a bracket and hook, in accordance with various embodiments.

FIG. 3B shows a right side view of a bracket 300 and hook 310, in accordance with various embodiments.

FIG. 3C top view of a bracket 300 and hook 310, in accordance with various embodiments.

FIG. 3D shows a right side perspective view of a bracket 300 and hook 310, in accordance with various embodiments.

Figure 4:
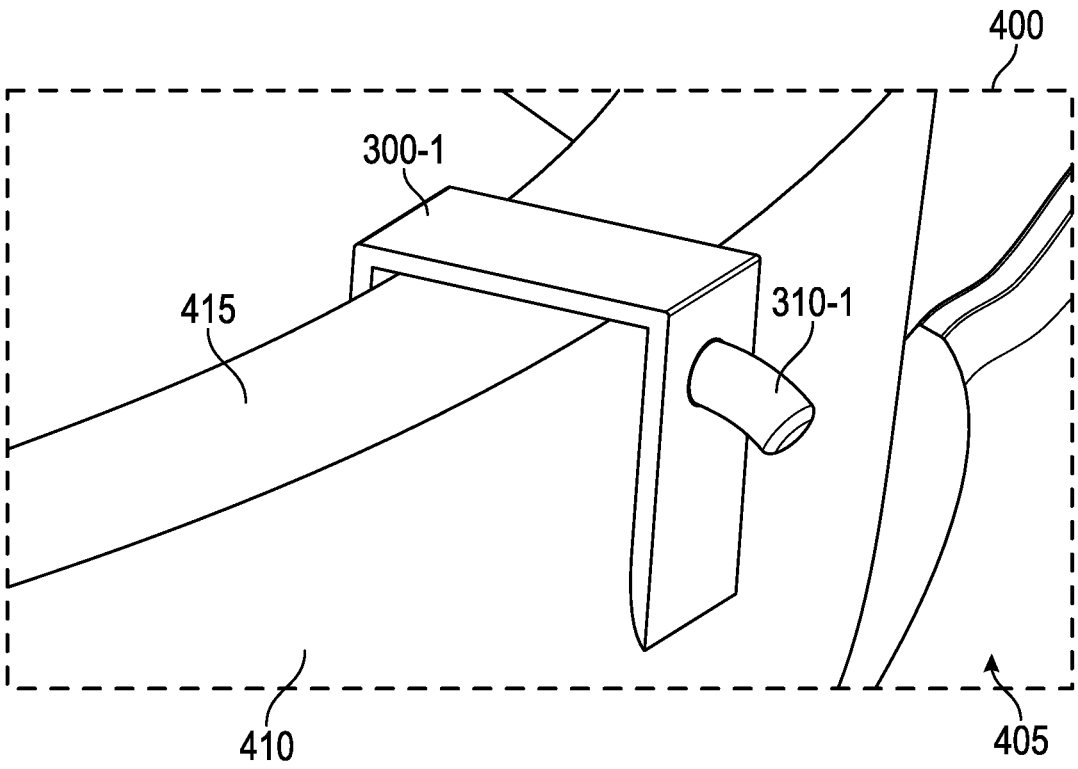
FIG. 4 shows a front left perspective detail view of the bracket installed on the rim of a toilet bowl with the hook extending outward and down away from the toilet bowl, in accordance with various embodiments.

FIG. 4 shows a front left perspective detail view 400 of a bracket 300-1 installed on the rim 415 of a toilet bowl 410 of a toilet 405 with the hook 310-1 extending outward and down away from the toilet bowl 410, in accordance with various embodiments.

Example Toilet Shielding System

In some embodiments, a toilet shielding system is comprised of a toilet shield (one embodiment illustrated in FIGS. 1A-1E and another embodiment illustrated in FIGS. 2A-2E) and a bracket 300 which is coupled to a hook 310. Although toilet shield 100 is depicted in use in FIGS. 5-7B, use of either of these toilet shield 100 or 200 in such a system would be carried out in a similar fashion to the examples shown in FIGS. 5-7B.

Figure 5:
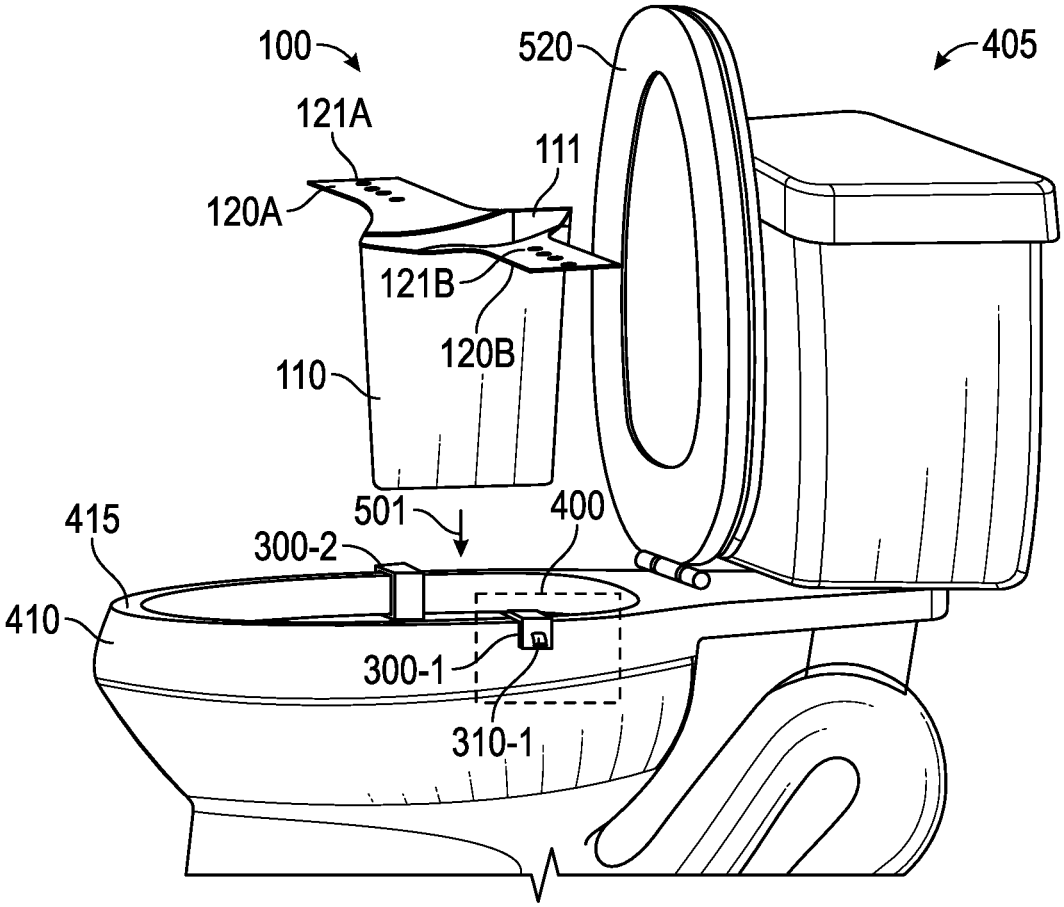
FIG. 5 shows a front right perspective view of an example of the toilet shield being lowered into the bowl of a toilet, in accordance with various embodiments.

FIG. 5 shows a front right perspective view of an example of the toilet shield 100 being lowered into the bowl 410 of a toilet 405, in accordance with various embodiments. Directional arrow 501, shows the direction in which it is being lowered. Toilet seat 520 is in an "up" position and has not yet been lowered onto rim 415. Brackets 300-1 and 300-2 are visible installed on the rim 415 of toilet 405, as is hook 310-1.

Figure 6:
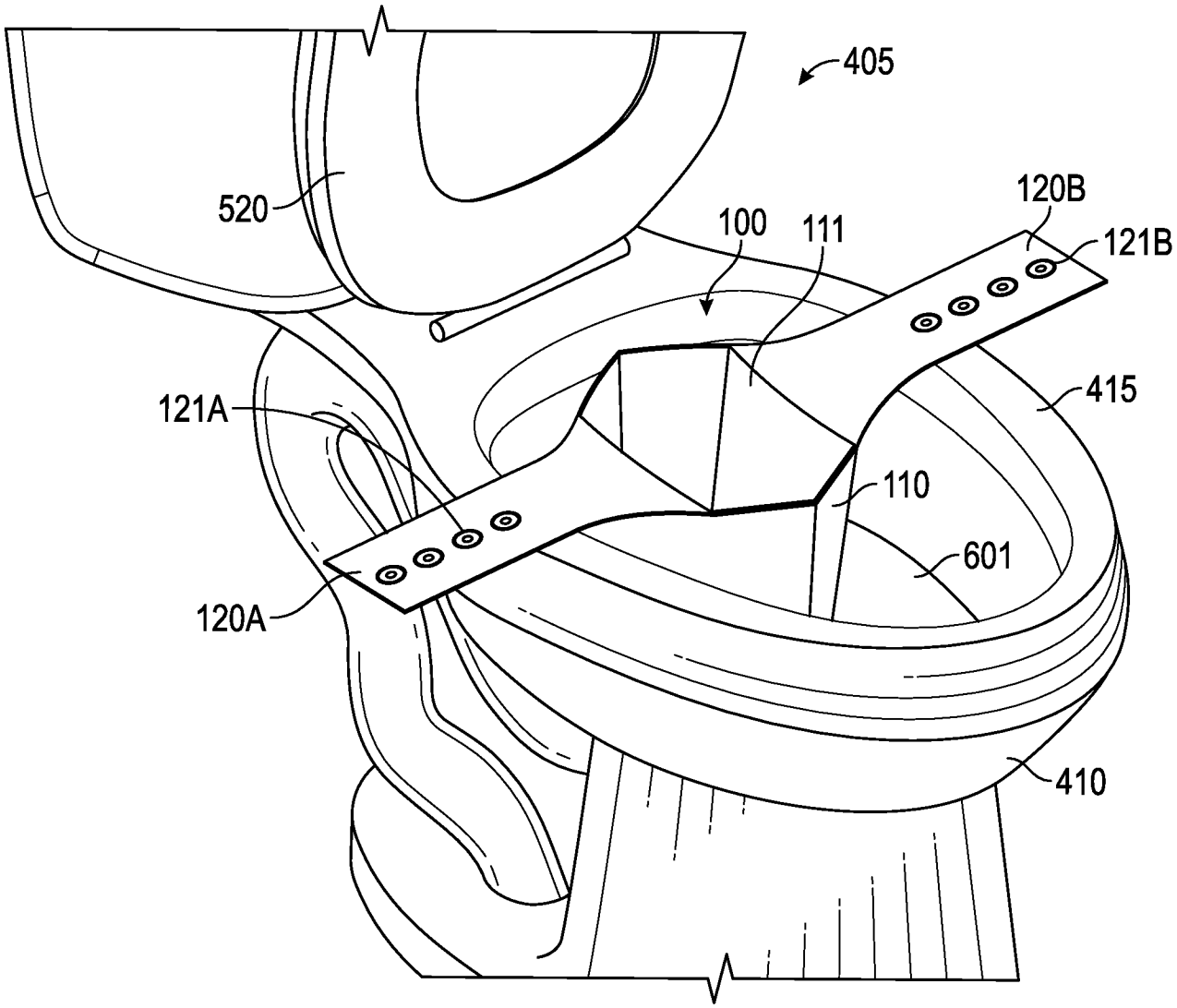
FIG. 6 shows a front left upper perspective detail view of an example of the toilet shield lowered into the bowl of the toilet with the arms extended but not yet secured, in accordance with various embodiments.

FIG. 6 shows a front left upper perspective view of an example of the toilet shield 100 lowered into the bowl 410 of the toilet 405 (only a partial view of toilet 405 is shown) with the arms 120A and 120B extended but not yet secured, in accordance with various embodiments. In some embodiments, the toilet seat 520 may be lowered onto the extended arms 120A and 120B to hold them in place and extended, causing the lumen 111 to remain open for receiving human feces during defecation. In some embodiments, an adhesive may be disposed between the arms 120A and 120B and the rim 415 of the bowl 410 of the toilet 405 to hold the arms 120A and 120B in place and extended, causing the lumen 111 to remain open for receiving human feces during defecation. A bottom portion of toilet shield 100 may be suspended in or slightly above water 601. In some embodiments, the extended arms 120A and 120B may be secured to the hooks 310 (not visible in FIG. 5) on either side of the toilet bowl 410; where the hooks 310 hold the arms 120A and 120B in place and extended, causing the lumen 111 to remain open for receiving human feces during defecation and simultaneously shielding the bowl 410 and other portions of the toilet 405 from splatter of loose stool.

Figure 7A:
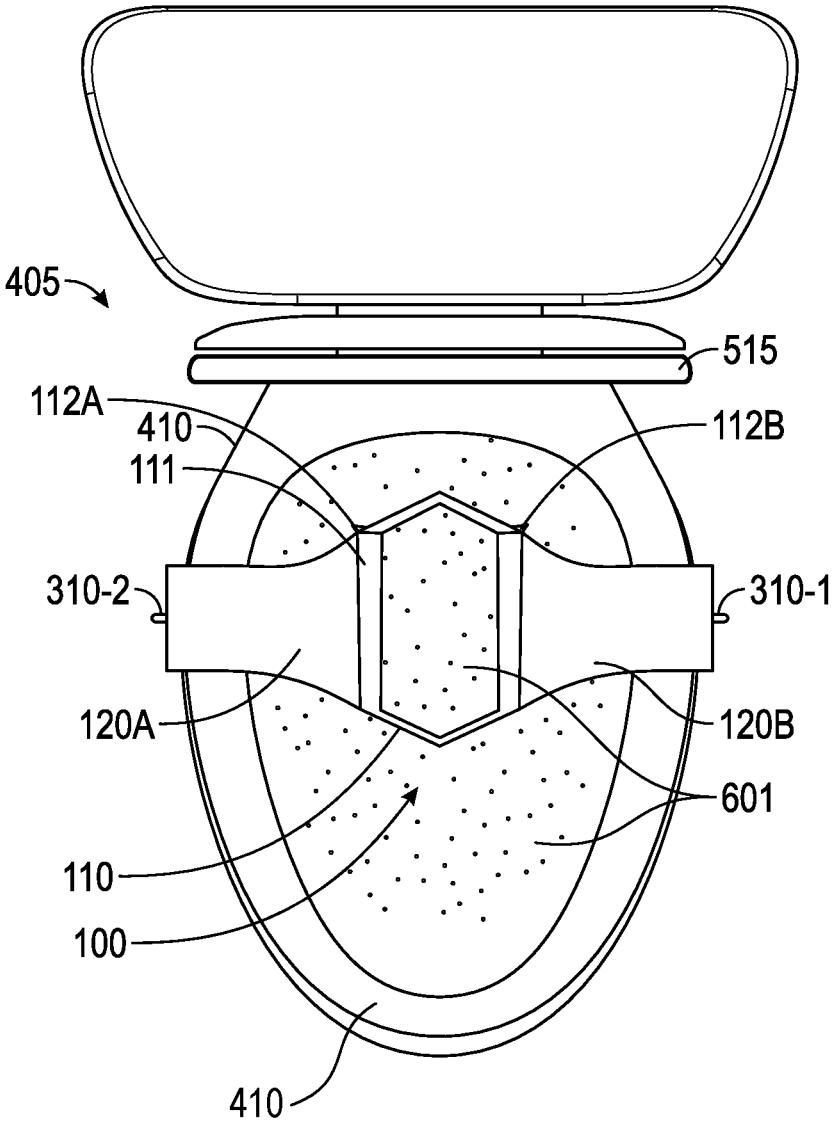
FIG. 7A shows a top view an example of the toilet shield lowered into the bowl of the toilet with the arms extended and bent to secure to hooks of brackets installed on the rim of the toilet bowl, in accordance with various embodiments.

FIG. 7A shows a top view an example of the toilet shield 100 lowered into the bowl 410 of the toilet 405 with the arms 120A and 120B extended and bent to secure to hooks 310-1 and 310-2 of brackets 300-1 and 300-2 (not visible in FIG. 7A) installed on the rim 415 of the toilet bowl 410, in accordance with various embodiments. Securing the extended arms 120A and 120B to the hooks 310-2 and 310-1 on either side of the toilet bowl 410, as shown, holds the arms 120A and 120B in place and causes the lumen 111 to remain open for receiving human feces during defecation. As has been discussed, other means of securing arms 120 may be used instead of hooks 310. In FIG. 7A, the toilet seat 520 is still in an upright position.

Figure 7B:
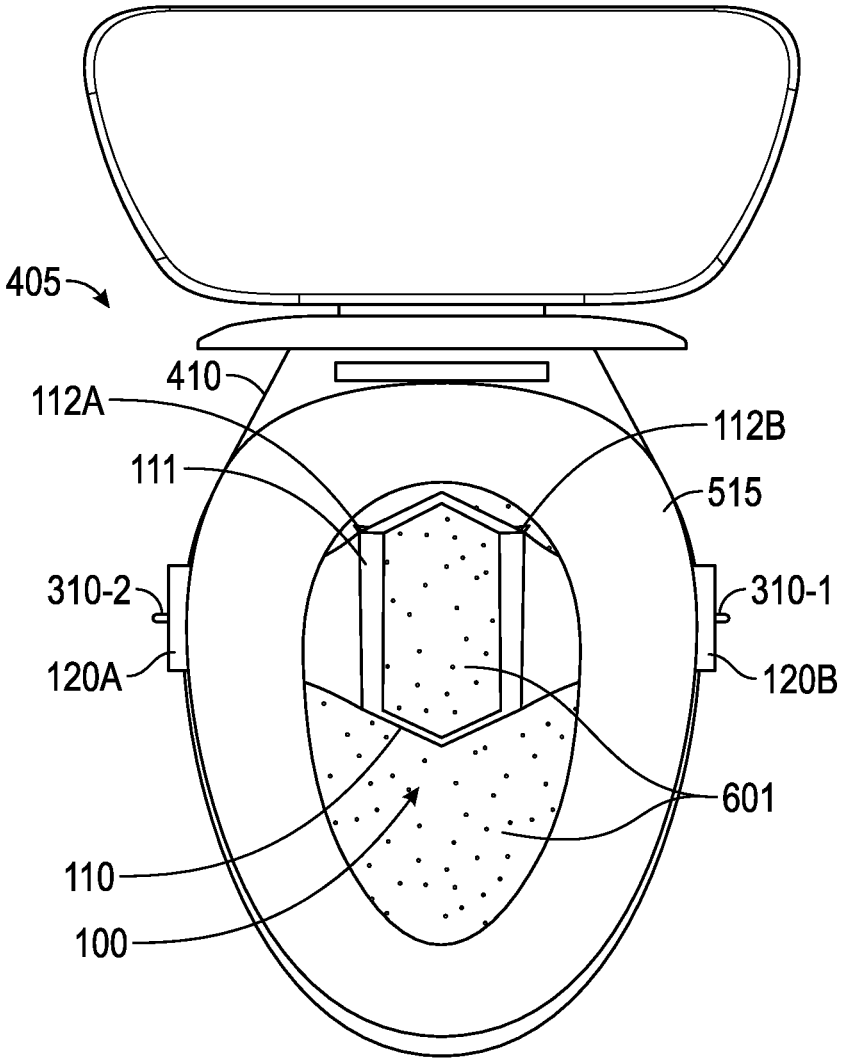
FIG. 7B shows a top view an example of the toilet shield lowered into the bowl of the toilet with the arms extended and bent to secure to hooks of brackets installed on the rim of the toilet bowl, in accordance with various embodiments.

FIG. 7B shows a top view an example of the toilet shield 100 lowered into the bowl 410 of the toilet 405 with the arms 120A and 120B extended and bent to secure to hooks 310-1 and 310-2 of brackets 300-1 and 300-2 (not visible in FIG. 7B) installed on the rim 415 of the toilet bowl 410, in accordance with various embodiments. FIG. 7B is the same as FIG. 7A except the toilet seat 520 has been lowered and the toilet 405 is ready for a human to sit on it and defecate into the open lumen 111 of the toilet shield 100.

Example Method of Use

In some embodiments, first the toilet seat 520 is lifted (if not already lifted) and two plastic brackets 300-1 and 300-2 are attached onto the rim 415 of the toilet bowl 410, one on either side, across from each other, when looking down at the toilet at 2:30 and 9:30 on the clockface. An example of this is illustrated in FIG. 5. The plastic brackets 300 may be left in place and used multiple times. The multiuse plastic brackets 300, when employed, may be small and made from biodegradable plastic so as not to add to the earth's plastic burden.

To prepare the toilet shield 100/200 for use, the opposing arms 120/220 are extended outward, with the distal tips of the arms extended generally away from each other. An example of this is shown in FIG. 5. When the arms 120/220 are pulled away from each other the lumen 111, channel 211, or curtain of the toilet shield 100/200 opens forming an open top end for receiving human feces. In some embodiments, the ends of the arms 120/220 are attached to the plastic brackets 300, such as by piercing the arm 120/220 with the hook 310 or by positioning the hook 310 in a preconfigured adjustment hole 121/221 in an arm 120/220. An example of this is shown in FIGS. 7A and 7B. In other embodiments, the ends of the arms 120/220 are attached to generally opposing sides of the toilet bowl 410 and/or the rim 415 of the toilet bowl 410 by other means such as adhesive or hook and loop fasteners.

In some embodiments, attaching the ends of the arms 120/220 to the hooks 310 on the plastic brackets 300 causes the toilet shield 100/200 to become suspended from the brackets 300 like a hammock between two trees (see for example FIGS. 6, 7A, and 7B). In some embodiments, a portion of the arms 120/220, such as the tips of the arms 120/220, may feature several preconfigured holes 121/221 to allow for adjustment of the height of the substantially vertical portion of the toilet shield 100/200. These adjustment holes 121/221 also facilitate positioning the toilet shield 100/200 within toilet bowls 410 of a variety of widths while ensuring the lumen 111, channel 211, or curtain is adequately opened to receive expelled human feces.

The toilet seat 520 is closed/lowered and the toilet shield 100/200 is ready for use. An example of this is illustrated in FIG. 7B. This can be done ahead of time (e.g., an hour in advance) as may occur in care giving situation or immediately prior to use.

In other embodiments, other fastening/suspension means may be employed. For example, in addition to or in alternative to the use of the bracket 300 and hook 310 on opposite sides of the toilet bowl 410, an adhesive may be employed between the rim 415 of the toilet bowl 410 and the arms 120/220 of the toilet shield 100/200. In some embodiments, for example, an adhesive strip is incorporated on the arms 120/220 of the toilet shield 100/200 during manufacturing.

In use, the toilet shield 100/200 collects liquid/splattered feces that does not drop vertically preventing it from fouling the toilet. The toilet shield 100/200 also slows the descent of feces that may be falling or spewing under pressure. When falling feces hits the water 601 some splashes upward and is big source of cleaning problems. The toilet shield 100/200 discourages this splashing upward by lessening the amount of feces that hits the water 601 directly and by slowing the descent of feces that does hit the water 601. The toilet shield also catches feces that are splashing upward from the water 601 impeding and/or preventing the splashed feces from reaching and fouling the toilet.

Once the toilet shield 100/200 is used the person using it (or a care giver) can simply release the arms 120/220 from the toilet bowl 410. For example, in some embodiments, this involves releasing the toilet shield 100/200 from hooks 310 on the outside of the toilet bowl 410, one on either side, by lifting the arms 100/200 off the hooks 310. This may accomplished without changing position, with the toilet seat 520 down and without coming in contact with anything untoward.

Once released, the weight of the feces and/or water 601 in the toilet bowl 410 pulls the toilet shield 100/200 into the water or the swirling motion of the flushed water 601 pulls it in the toilet bowl 410, and it is flushed away.

The toilet shield 100/200 can also be used without mounting brackets 300 or other attachment means by placing the arms 120/220 on top of the toilet seat 520 and holding it in place by the weight of the user. For example, a toilet seat 520 may be lowered onto the rim 415 of a toilet bowl 410. A toilet shield 100/200 is expanded by pulling its arms 120/220 in generally opposite directions. The arms 120/220 may be draped over the lowered toilet seat 520 at locations which are in the vicinity of 2:30 and 9:30 on the face of a clock (if the rear of the toilet seat is considered 12:00), and after positioning the toilet shield 100/200 at the desired elevation within the bowl 410 the excess length of the arms 120/220 is then tucked under the toilet seat 520 (e.g., between the toilet seat 520 and the rim 415). The user then sits on the toilet seat and the arms 120/220 which are exposed on the top surface of the seat 520 while defecating. After defecating, the user would exit the toilet 405 at least slightly to release the toilet shield 100/200, and then flush the toilet 405 to flush the toilet shield 100/200 in to the sewer/septic system to which the toilet 405 is coupled.

CONCLUSION

The examples set forth herein were presented in order to best explain, to describe particular applications, and to thereby enable those skilled in the art to make and use embodiments of the described examples. However, those skilled in the art will recognize that the foregoing description and examples have been presented for the purposes of illustration and example only. The description as set forth is not intended to be exhaustive or to limit the embodiments to the precise form disclosed. Rather, the specific features and acts described above are disclosed as example forms of implementing the claims.

In accordance with the embodiments shown, one of ordinary skill in the art will readily recognize that there could be variations to the embodiments and those variations would be within the spirit and scope of what has been disclosed. Accordingly, many modifications may be made by one of ordinary skill in the art without departing from the spirit and scope of the disclosure.

Reference throughout this document to "one embodiment," "certain embodiments," "an embodiment," "various embodiments," "some embodiments," or similar term means that a particular feature, structure, or characteristic described in connection with the embodiment is included in at least one embodiment. Thus, the appearances of such phrases in various places throughout this specification are not necessarily all referring to the same embodiment. Furthermore, the particular features, structures, or characteristics of any embodiment may be combined in any suitable manner with one or more other features, structures, or characteristics of one or more other embodiments without limitation.

What is claimed is:

1. A toilet shield comprising:

a tube;

a first arm, the first arm coupled with a first side of a lumen of the tube and comprising a first plurality of adjustment holes configured into the first arm; and a second arm, the second arm coupled to a second side of the lumen of the tube and comprising a second plurality of adjustment holes configured into the second arm, wherein the tube is configured such that the lumen of the tube opens in response to the first arm and the second arm being extended in generally opposite in directions.

2. The toilet shield of claim 1, wherein:

in response to a first adjustment hole of the first plurality of adjustment holes being coupled with a first hook of a first bracket clipped to a first portion of a rim of a toilet bowl and a second adjustment hole of the second plurality of adjustment holes being coupled with a second hook of a second bracket is clipped to a second portion of the rim of the toilet bowl, the toilet shield is configured to suspend across the toilet bowl with the lumen held open to receive feces from human defecation.

3. The toilet shield of claim 1, wherein:

in response to the first arm being coupled with a first portion of a rim of a toilet bowl and the second arm being coupled with a second portion of the rim of the toilet bowl, the toilet shield is configured to suspend across the toilet bowl with the lumen held open to receive feces from human defecation.

4. The toilet shield of claim 1, wherein:

the tube is composed of a flushable material.

5. The toilet shield of claim 4, wherein:

the flushable material comprises paper.

6. The toilet shield of claim 1, wherein:

the first arm and the second arm or composed of a flushable material.

7. A toilet shielding system comprising:

a first bracket configured to clip to a first portion of a rim of a toilet bowl, the first bracket comprising a first hook which extends outward from the toilet bowl when the first bracket is clipped to the first portion of the rim of the toilet bowl;

a second bracket configured to clip to a second portion of the rim of the toilet bowl, the second bracket comprising a second hook which extends outward from the toilet bowl when the second bracket is clipped to the second portion of the rim of the toilet bowl, wherein the first portion of the rim of the toilet bowl and the second portion of the rim of the toilet bowl are on opposite lateral sides of the toilet bowl; and a toilet shield comprising:

a tube composed of a flushable material;

a first arm composed of the flushable material, the first arm coupled with a first side of a lumen of the tube and comprising a first plurality of adjustment holes configured into the first arm; and a second arm composed of the flushable material, the second arm coupled to a second side of the lumen of the tube and comprising a second plurality of adjustment holes configured into the second arm, wherein the tube is configured such that the lumen of the tube opens in response to the first arm and the second arm being in extended generally opposite in directions; and wherein, in response to a first adjustment hole of the first plurality of adjustment holes being coupled with the first hook while the first bracket is clipped to the first portion of the toilet bowl and a second adjustment hole of the second plurality of adjustment holes being coupled with the second hook while the second bracket is clipped to the second portion of the toilet bowl, the toilet shield is configured to suspend across the toilet bowl with the lumen held open to receive feces from human defecation.

8. The toilet shielding system of claim 7, wherein:

the flushable material comprises paper.

9. The toilet shielding system of claim 7, wherein:

the flushable material comprises polyvinyl alcohol film.

10. A toilet shield comprising:

a gutter shaped portion with an interior channel, the interior channel comprising:

a rear vertical wall;

a first vertical side wall; and a second vertical side wall;

a first arm, the first arm coupled with the first vertical side wall of the interior channel of the gutter shaped portion and comprising a first plurality of adjustment holes configured into the first arm; and a second arm, the second arm coupled to a second vertical side wall of the interior channel of the gutter shaped portion and comprising a second plurality of adjustment holes configured into the second arm, wherein the gutter shaped portion is configured such that the interior channel of the gutter shaped portion opens in response to the first arm and the second arm being extended in generally opposite in directions.

11. The toilet shield of claim 10, wherein:

in response to a first adjustment hole of the first plurality of adjustment holes being coupled with a first hook of a first bracket clipped to a first portion of a rim of a toilet bowl and a second adjustment hole of the second plurality of adjustment holes being coupled with a second hook of a second bracket is clipped to a second portion of the rim of the toilet bowl, the toilet shield is configured to suspend across the toilet bowl with the interior channel of the gutter shaped portion held open to receive feces from human defecation.

12. The toilet shield of claim 10, wherein:

in response to the first arm being coupled with a first portion of a rim of a toilet bowl and the second arm being coupled with a second portion of the rim of the toilet bowl, the toilet shield is configured to suspend across the toilet bowl with the interior channel of the gutter shaped portion held open to receive feces from human defecation.

13. The toilet shield of claim 10, wherein:

the gutter shaped portion is composed of a flushable material.

14. The toilet shield of claim 13, wherein:

the flushable material comprises paper.

15. The toilet shield of claim 10, wherein:

the first arm and the second arm or composed of a flushable material.

16. A toilet shielding system comprising:

a first bracket configured to clip to a first portion of a rim of a toilet bowl, the first bracket comprising a first hook which extends outward from the toilet bowl when the first bracket is clipped to the first portion of the rim of the toilet bowl;

a second bracket configured to clip to a second portion of the rim of the toilet bowl, the second bracket comprising a second hook which extends outward from the toilet bowl when the second bracket is clipped to the second portion of the rim of the toilet bowl, wherein the first portion of the rim of the toilet bowl and the second portion of the rim of the toilet bowl are on opposite lateral sides of the toilet bowl; and a toilet shield comprising:

a gutter shaped portion with an interior channel, the interior channel comprising:

a rear vertical wall;

a first vertical side wall; and a second vertical side wall;

a first arm, the first arm coupled with the first vertical side wall of the interior channel of the gutter shaped portion and comprising a first plurality of adjustment holes configured into the first arm; and a second arm, the second arm coupled to a second vertical side wall of the interior channel of the gutter shaped portion and comprising a second plurality of adjustment holes configured into the second arm, wherein the gutter shaped portion is configured such that a channel of the gutter shaped portion opens in response to the first arm and the second arm being extended in generally opposite in directions; and wherein, in response to a first adjustment hole of the first plurality of adjustment holes being coupled with the first hook while the first bracket is clipped to the first portion of the toilet bowl and a second adjustment hole of the second plurality of adjustment holes being coupled with the second hook while the second bracket is clipped to the second portion of the toilet bowl, the toilet shield is configured to suspend across the toilet bowl with the interior channel of the gutter shaped portion held open to receive feces from human defecation.

17. The toilet shielding system of claim 16, wherein:

the gutter shaped portion comprises flushable material.

18. The toilet shielding system of claim 16, wherein:

the first arm and the second arm comprise flushable material.

* * * * *